US005087324A

United States Patent [19]

Awofeso et al.

[11] Patent Number: 5,087,324

[45] Date of Patent: Feb. 11, 1992

[54] PAPER TOWELS HAVING BULKY INNER LAYER

[75] Inventors: Anthony O. Awofeso, Appleton; Frank D. Harper, Neenah, both of Wis.

[73] Assignee: James River Corporation of Virginia, Richmond, Va.

[21] Appl. No.: 606,900

[22] Filed: Oct. 31, 1990

[51] Int. Cl.[5] ..... D21H 11/16

[52] U.S. Cl. ..... 162/111; 162/113; 162/129; 162/130; 162/142; 162/146; 162/149

[58] Field of Search ..... 162/9, 22, 21, 13, 100, 162/111, 112, 113, 129, 130, 157.6, 142, 150, 146, 149

[56] References Cited

U.S. PATENT DOCUMENTS

| | | | |
|---|---|---|---|
| D. 231,018 | 3/1974 | Gilling et al. | D59/2 A |
| 3,434,918 | 3/1969 | Bernardin | 162/111 |
| 3,707,436 | 12/1972 | O'Connor | 162/22 |
| 3,994,771 | 11/1976 | Morgan | 162/113 |
| 4,036,679 | 7/1977 | Back et al. | 162/9 |
| 4,100,017 | 7/1978 | Flautt | 162/111 |
| 4,163,687 | 8/1979 | Mamers et al. | 162/21 |
| 4,166,001 | 8/1979 | Dunning et al. | 162/129 |
| 4,225,382 | 9/1980 | Kearney et al. | 162/111 |
| 4,344,818 | 8/1982 | Nuttall et al. | 162/129 |
| 4,464,224 | 8/1984 | Matolcsy | 162/111 |
| 4,488,932 | 12/1984 | Eber et al. | 162/13 |
| 4,781,793 | 11/1988 | Halme | 162/55 |
| 4,795,530 | 1/1989 | Soerens et al. | 162/111 |
| 4,798,651 | 1/1989 | Kokta | 162/22 |
| 4,853,086 | 8/1989 | Graef | 162/157.6 |
| 4,869,782 | 9/1989 | Nelson et al. | 162/9 |

FOREIGN PATENT DOCUMENTS

| | | | |
|---|---|---|---|
| 153182 | 8/1985 | European Pat. Off. | 162/21 |
| 0213415 | 11/1987 | European Pat. Off. . | |
| 88/04704 | 6/1988 | World Int. Prop. O. . | |

*Primary Examiner*—Peter Chin

[57] ABSTRACT

A delaminated stratified paper towel includes a dense first layer of chemical fiber blend and a second layer of a bulky anfractuous fiber blend unitary with the first layer. The first and second layers enhance a rate of absorption and water holding capacity of the paper towel. In a preferred embodiment, the second layer is a fiber blend having a high bulk softwood fiber and a chemi-thermomechanical pulp. A method of forming a delaminated stratified web of paper towel material includes supplying a first furnish directly to a wire and supplying a second furnish of a bulky anfractuous fiber blend directly onto the first furnish disposed on the wire. Drying the first and second furnishes forms a web of paper towel material having a predetermined dryness. The web of paper towel material is thereafter creped off of the drying device and embossed to a predetermined emboss depth. The web of paper towel material has an enhanced rate of absorption and water holding capacity.

18 Claims, 9 Drawing Sheets

PAPER TOWELS HAVING BULKY INNER LAYER

BACKGROUND OF THE INVENTION

1. Field of the Invention

A stratified paper towel includes a first dense layer of Kraft fiber blend and unitary therewith a second layer of bulky anfractuous fiber blend wherein the first and second layers enhance a rate of absorption and water holding capacity for the paper towel, the weight of the dense layer of Kraft fiber blend being no less than about the weight of the bulky anfractuous fiber blend.

2. Description of Background Art

Hithertofore, paper towels have been constructed of a fiber blend material. Normally, creping of the fiber blend material provides an improvement in the absorbency attribute. However, the rate of absorption is often sacrificed for capacity. An absorbent paper towel using blended fibers which includes a denser top layer for strength and an anfractuous bottom layer for improved water absorption capacity without sacrificing rate of absorption has not hithertofore been developed.

SUMMARY OF THE INVENTION

The present invention provides a paper towel with an improved structure for enhancing a rate of absorption and water holding capacity of the towel by simultaneously forming a dense first layer of fiber blend and a second layer of bulky anfractuous fiber blend, the weight of the first layer being no less than about the weight of the bulky anfractuous fiber blend. The second layer of bulky anfractuous fiber blend includes a combination of a stiff long fiber high strength mechanical pulp and a high bulk softwood fiber which provides a unique structure for enhancing rate of absorption and water holding capacity of the paper towel.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF SUMMARY OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

The preferred towels of the present invention comprise a unitary stratified structure comprising a dense first layer of a chemical pulp hardwood-softwood fiber blend (more preferably about 70% Kraft softwood and about 30% Kraft hardwood fiber) and a second layer of bulky anfractuous fiber blend. The bulky anfractuous fiber blend includes a combination of a stiff, long fiber high strength mechanical pulp and a high bulk softwood fiber. The stiff, long fiber high strength mechanical pulp may comprise any of the pretreated mechanical pulps such as thermomechanical pulp, chemi-mechanical pulp, but preferably a chemi-thermomechanical pulp. The high bulk fiber is preferably a softwood fiber which has been treated to render the fibers three dimensional, curly or fluffy (as opposed to the normally somewhat linear fiber configuration) and then "crosslinked" to "set" the three dimensional, curly or fluffy structure. As is understood in the art, the exact chemical nature of "crosslinking" or "setting" may not correspond precisely to crosslinking as that term is used in polymer science but rather comprehends several processes such as those described in U.S. Pat. No. 4,853,086 and European Published Application 0213415. Treatments with citric acid as well can impart a three dimensional character to the fiber as will glyoxal treatments such as result in Procter and Gamble's HPZ fiber.

By "unitary," we mean that the two layers in the sheet are essentially formed simultaneously as hereinafter described. By "stratified," we mean that layers corresponding to the specified fiber compositions can be observed in the finished towel even though the dividing line may not be distinct.

Figure 1:
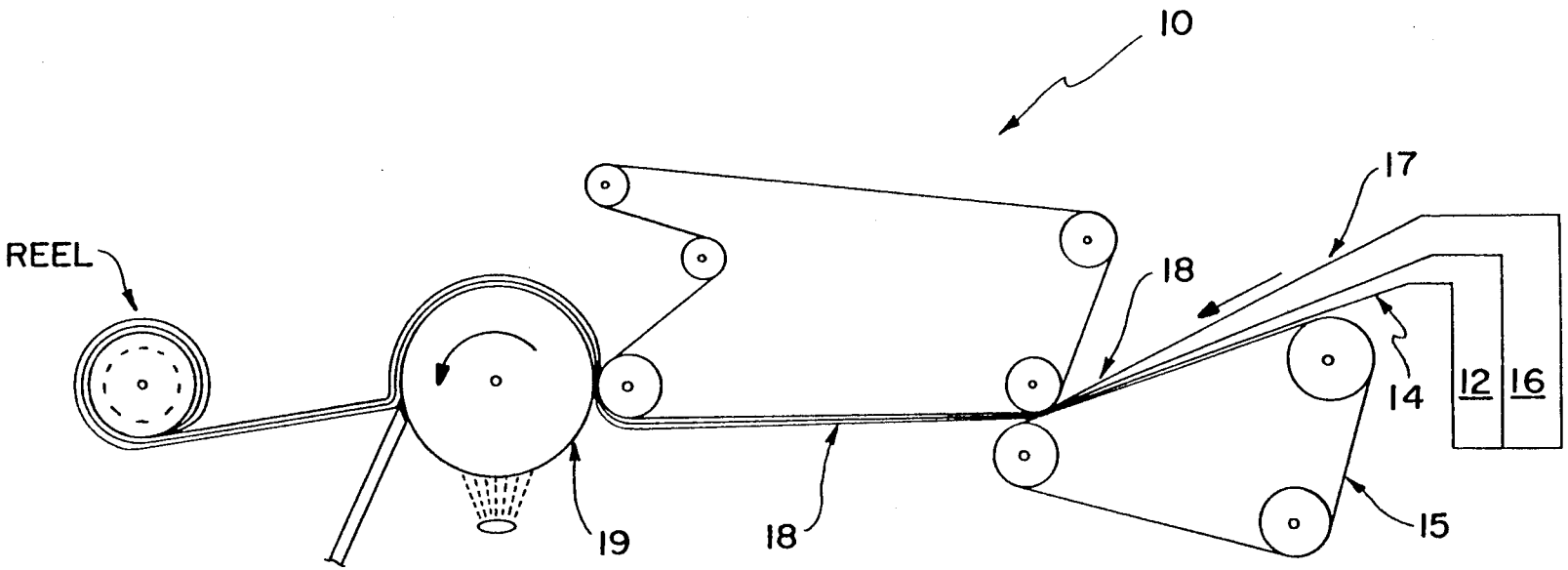
FIG. 1 is schematic view illustrating a first embodiment of the present invention wherein two furnishes are supplied to separate channels of a headbox forming a unitary stratified web which is thereafter, subsequently creped and embossed.

As illustrated in FIG. 1, paper forming device 10 is provided for forming stratified paper towel 18 according to the present invention. First, inside furnish 12 is supplied through lower headbox duct 14, direction to forming fabric 15. Second furnish 16 is supplied through upper headbox duct 17 to the layer previously formed by first furnish 12. Furnishes 12 and 16 are considered "wet furnishes" wherein the material comprises from approximately 15 to 40% solids when it reaches yankee dryer 19. Inside furnish 12 consists of a dense layer which in a preferred embodiment may be approximately 65% of the total weight of the paper towel, but less than 25% of the thickness. The inside layer preferably contains approximately 70% Kraft softwood and approximately 30% Kraft hardwood.

The remaining approximately 35% of the paper towel is supplied by the portion of the sheet resulting from second furnish 16. For comparative testing, second furnish 16 was constructed from four different materials to compare the absorption and water holding capacity of each type of paper towel. As a control, a towel was formed in which second furnish 16 contained 100% Kraft softwood pulp.

For comparative purposes, a second towel, referred to as the chemi-thermomechanical pulp towel (CTMP towel), included 100% Temcell CTMP (sold by Tembec, Inc.) on the air side of the stratified paper towel. This softwood pulp had an arithmetic average fiber length of 0.85 mm, a length weighted average fiber length of about 2 mm and a weight weighted average fiber length of about 2.6 mm. Approximately ⅓ of the fibers constituting however less than about 4% of the fiber weight were less than about 0.20 mm in length. A third comparative towel, designated the high bulk fiber towel (HBA towel) included, on the air side, approximately 57% Kraft hardwood and approximately 43% high bulk fiber commercially available as Weyerhaueser HBA fiber believed to be somewhat similar to those described in U.S. Pat. No. 4,853,086. A fourth towel, designated the chemi-thermomechanical pulp/high bulking fiber towel (CTMP/HBA towel), included, on the air side, approximately 57% CTMP and approximately 43% HBA. The construction of each ply of the four two ply towels, is set forth in Table 1 and is illustrated in FIGS. 3B, 4B, 5B and 6B.

HBA is a bleached Kraft pulp available from Weyerhaueser which is chemically and mechanically modified to make it suitable for bulking in wet laid paper applications. Its Kajaani weighted average fiber length is about 2.7 mm while the coarseness is about 34 mg per 100M. It has been suggested that HBA be used as a substitute for CTMP in tissues and towels, but insofar as is known to us, the combination of one layer of CTMP/HBA with another layer of Kraft pulp in a unitary sheet has not heretofore been known to provide the surprising combination of strength, water holding capacity, and high rate of absorption.

TABLE 1

| Towel Designation | Composition of Towel Base Sheets (Expressed as % of Total Furnish) | | | |
|---|---|---|---|---|
| | Hardwood | Softwood | CTMP | HBA |
| 1. Control Towel | 20 | 80 | — | — |
| 2. CTMP Towel | 20 | 45 | 35 | — |
| 3. HBA Towel | 40 | 45 | — | 15 |
| 4. CTMP/HBA Towel | 20 | 45 | 20 | 15 |

First furnish 12 and second furnish 16 form towel 18 which is supplied to the yankee dryer 19 wherein a substantial quantity of the water is removed. As the stratified towel reaches a dryness of approximately 60% to 95%, the stratified paper towel is creped off of the yankee dryer 19. Creping of the stratified paper towel increases the bulk and softness of the paper towel. Creping can take one of two forms. First, creping can produce a corrugated type of paper towel. In addition, creping can produce a loosening up of the fibers in the paper towel. This second form of creping, wherein the fibers are loosened up, is referred to in the present invention as a "delaminated" stratified paper towel.

Subsequent to creping, the delaminated stratified paper towel 18 from the yankee dryer 19 may be combined with another ply by passing the two between embossing rollers with the layers containing the bulky anfractuous fiber blend adjacent to each other to form two ply towels having the structures illustrated in FIGS. 3B, 4B, 5B and 6B, respectively. The embossing rollers penetrate the paper towel to a depth of 0.0508 cm to 0.2286 cm (0.02 to 0.09 inches). The pattern of embossing of the paper towel may be similar to that shown in U.S. Pat. No. Des. 231,018.

The four towels identified in Table 1 were made according to a method utilizing a paper forming device 10 as discussed hereinabove. To make meaningful comparisons possible between the four towels produced, the first furnish 12 and the second furnish 16 for each towel were selected to produce towels having approximately an equal dry strength as measured by the geometric of the cross direction and machine direction breaking lengths. In this art, we consider a dry breaking length of 668 to 762 meters to be approximately equal. The average physical properties of the stratified paper towel are set forth in Table 2. The calipers and breaking lengths reported have been normalized to a basis weight of 15.0 lbs/3000 sq ft ream.

TABLE 2

| Towel Designation | Base Sheet Physical Properties | | | | |
|---|---|---|---|---|---|
| | Caliper (mils/ 8 plies) | Breaking Length (meters) | | WHC (gm/gm) | WAT (sec) |
| | | Dry | Wet | | |
| 1. Control Towel | 47.4 | 762 | 199 | 7.0 | 35.6 |
| 2. CTMP Towel | 50.2 | 784 | 237 | 7.1 | 66.5 |
| 3. HBA Towel | 54.7 | 749 | 227 | 8.8 | 17.4 |
| 4. CTMP/HBA Towel | 59.1 | 668 | 195 | 9.5 | 11.0 |

After embossing each towel to emboss depths ranging from 0.0508 cm to 0.2286 cm (0.02 to 0.09 inches), the strength and water holding properties of the towels at each emboss depth were determined. The water holding properties were compared at equal towel strength levels to determine the gain and water holding capacity (WHC) due to the presence of the unique fibers added to the second furnish 16.

As used herein, WAT is an abbreviation for "water absorption time" which is specified as the time (in seconds) required for a 0.1 ml drop of water placed on the towel surface to be absorbed into the towel; WHC is an abbreviation for "water holding capacity" which is the amount of water retained in a sample immersed in water for one minute, then drained on a horizontal screen for 15 seconds.

At equal wet breaking lengths, the CTMP towel had a water holding capacity approximately 1.2 grams of water per gram of fiber higher than that of the control towel. The increase in WHC was approximately constant across the range of wet strengths resulting from the change in emboss depths. For the third towel, the HBA towel, the water holding capacity was about 2.5 grams of water per gram of fiber higher than the control towel. The fourth towel, containing both CTMP and HBA, maintained an increase in WHC of approximately 3.5 grams of water per gram of fiber over the WHC of the control towel throughout the range of wet strengths obtained. As an example, the water holding capacities obtained from the four towels at an emboss depth of 0.2286 cm (0.09 inches) are shown in Table 3. At this emboss depth, the wet strengths for all four towels were approximately equal. The dry strength and water absorption rate for the towels at the emboss depth of 0.2286 cm (0.09 inches) are also shown in Table 3. The caliper and breaking length values are normalized to 30 lbs/3000 sq. ft. ream converted towel.

TABLE 3

Physical Properties of Embossed Towels at an Emboss Depth of 0.2286 cm

| Towel Designation | Caliper (mils/ 8 plies) | Breaking Length (meters) Dry | Breaking Length (meters) Wet | WHC (gm/gm) | WAT (sec) |
|---|---|---|---|---|---|
| 1. Control Towel | 176 | 471 | 135 | 8.8 | 0.6 |
| 2. CTMP Towel | 185 | 450 | 142 | 10.0 | 1.2 |
| 3. HBA Towel | 194 | 400 | 138 | 11.3 | 0.9 |
| 4. CTMP/HBA Towel | 188 | 361 | 141 | 12.4 | 0.8 |

Figure 2:
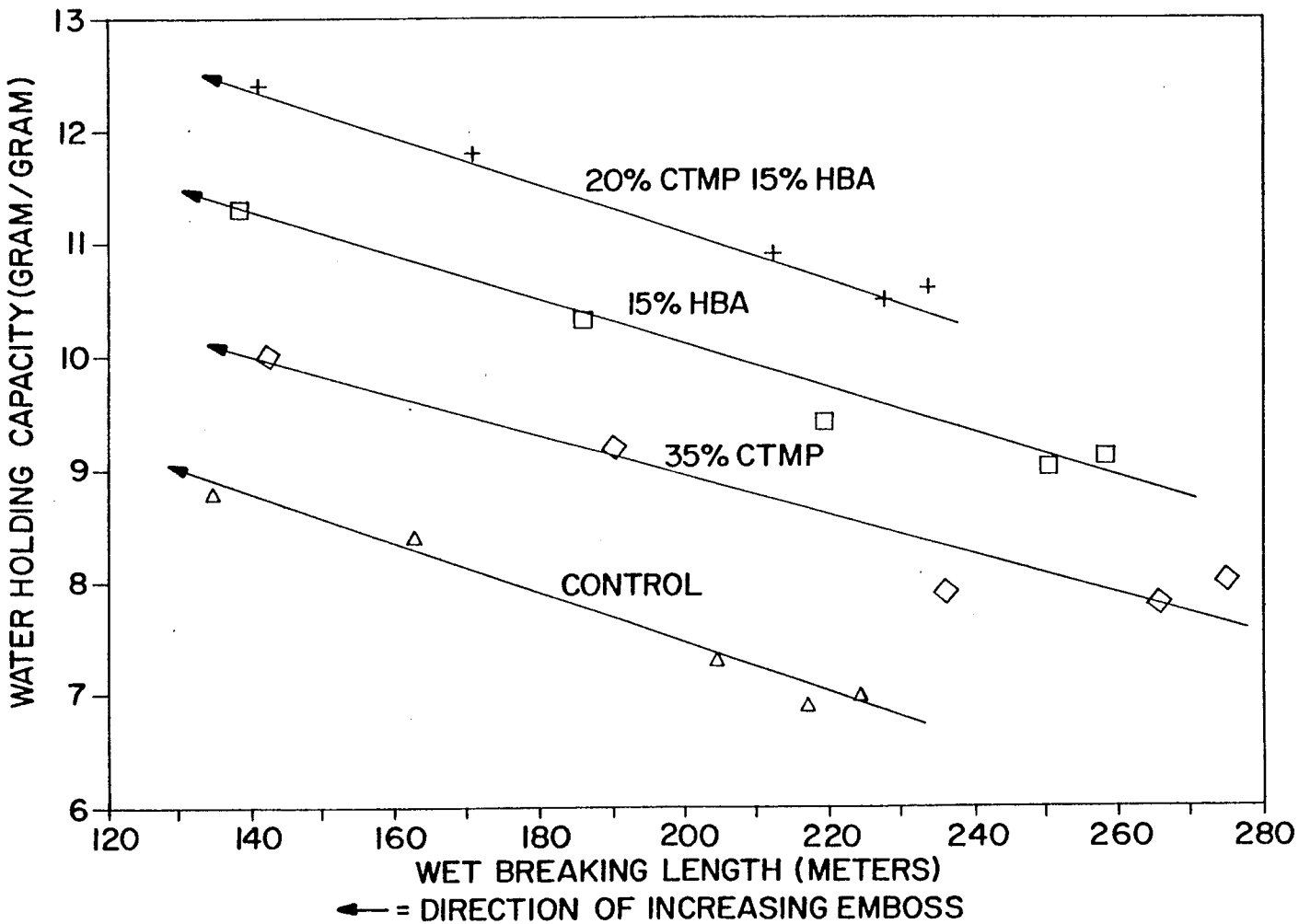
FIG. 2 illustrates data showing water holding capacity of four different paper towel structures.

FIG. 2 illustrates the data for the range of embossed penetrations for the four towels identified hereinabove. At a given wet strength, the blend of approximately 15% HBA and approximately 20% CTMP yields a towel structure that produced a better water holding capacity as compared to the control towel, CTMP towel and HBA towel.

Figure 3A:
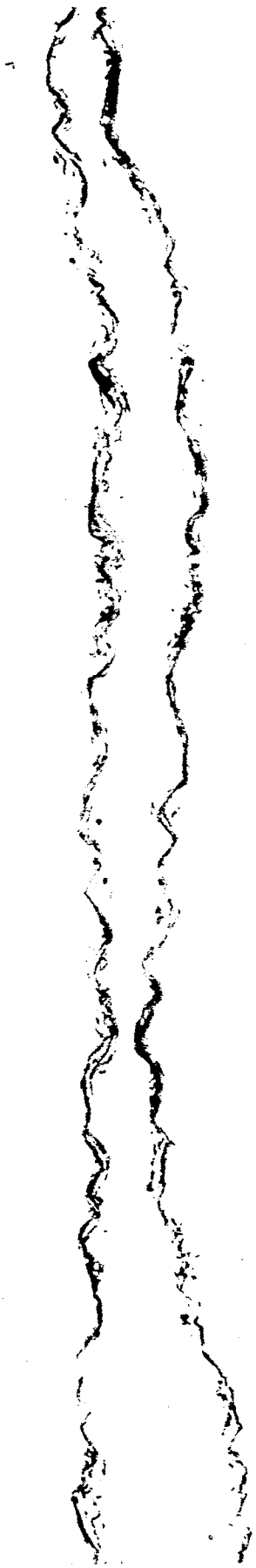
FIG. 3A is a microscopic cross-sectional view of the control paper towel.
Figure 3B:
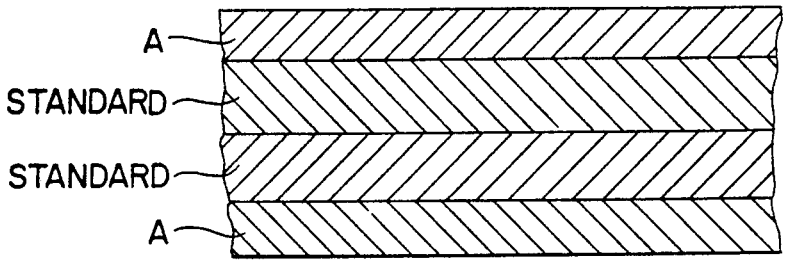
FIG. 3B is a schematic sectional illustration of the structure of the towel illustrated in FIG. 3A.

FIG. 3A is a light microscopy cross-sectional view of the embossed, converted and finished control towel magnified by 50 times. As illustrated in FIG. 3B, the control towel is constructed of two plies, each ply including two layers. As each ply is constructed on the paper machine, the layer A is the inside furnish comprising approximately 70% Kraft softwood and 30% Kraft hardwood. The other layer of the control towel is 100% Kraft softwood pulp which is applied as the outside furnish on the paper machine. The ply consisting of the layer A and the other layer is formed as a two layer sheet, and thereafter, joined together with an additional identical two layer sheet to create a two ply towel with the A layers forming the exterior surfaces of the towel and the other layers being joined to each other.

Figure 4B:
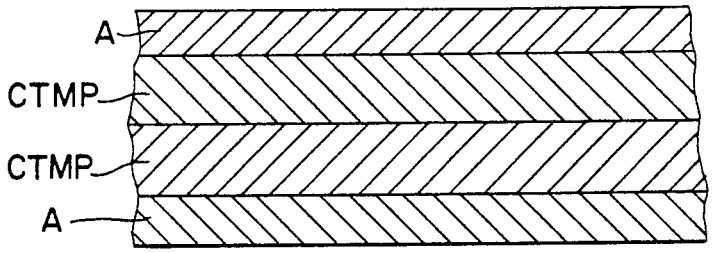
FIG. 4B is a schematic sectional illustration of the structure of the towel illustrated in FIG. 4A.
Figure 5B:
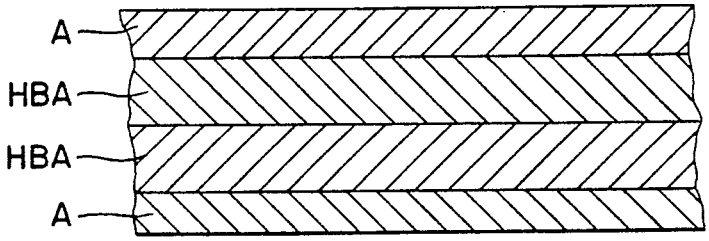
FIG. 5B is a schematic sectional illustration of the structure of the towel illustrated in FIG. 5A.
Figure 4A:
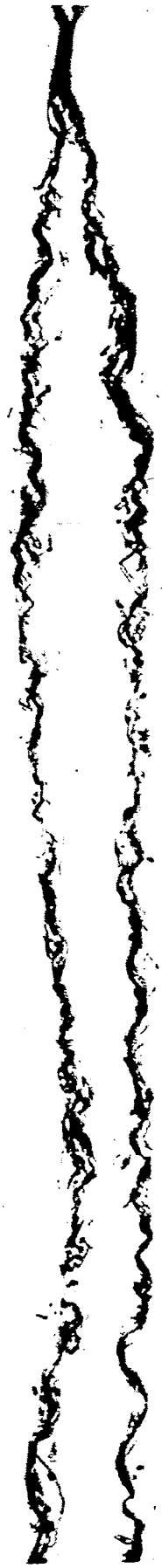
FIG. 4A is a microscopic view of the chemithermomechanical pulp paper towel.

Similarly, FIG. 4A is a 50× light microscopy cross-sectional view of the CTMP towel. Layer A is again constructed of 70% Kraft softwood and 30% Kraft hardwood. The CTMP layer is constructed of 100% softwood Temcell CTMP. A two layer sheet including a layer A and a layer of CTMP material are constructed as a unitary sheet. Thereafter, a second identical sheet is joined together with the first sheet to create a composite towel as illustrated in FIG. 4B.

Figure 5A:
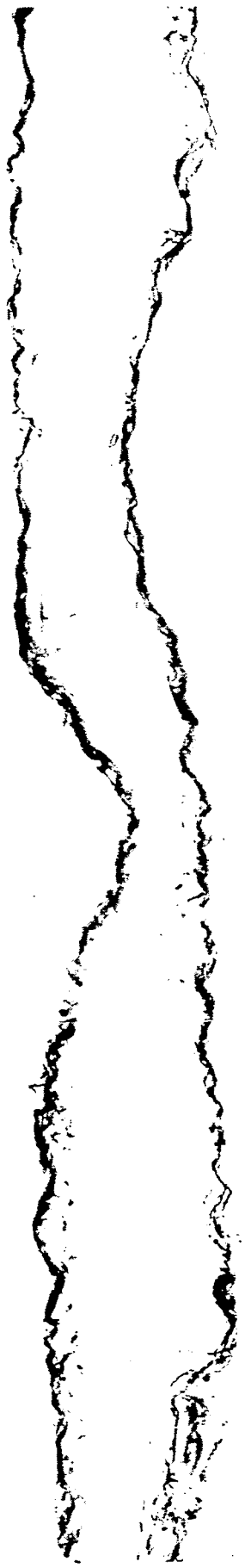
FIG. 5A is a microscopic view of the high bulk fiber paper towel.

FIG. 5A is a 50× light microscopy cross-sectional view of the HBA towel. A sheet including a layer A consisting of approximately 70% Kraft softwood and 30% Kraft hardwood is joined together in a single unitary sheet with a layer of HBA material which includes approximately 57% Kraft hardwood and 43% HBA. This sheet is joined together with a second identical sheet to create the two ply towel illustrated in FIG. 5B.

Figure 6B:
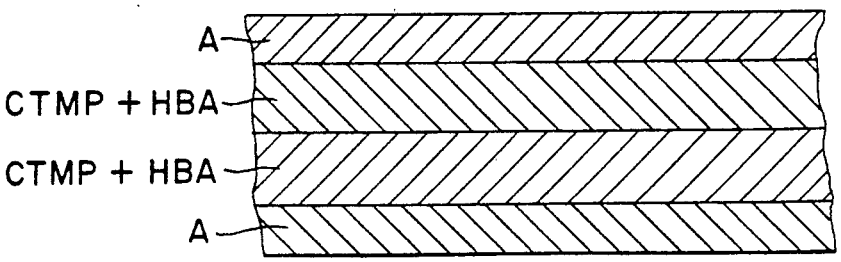
FIG. 6B is a schematic sectional illustration of the structure of the towel illustrated in FIG. 6A.
Figure 6A:
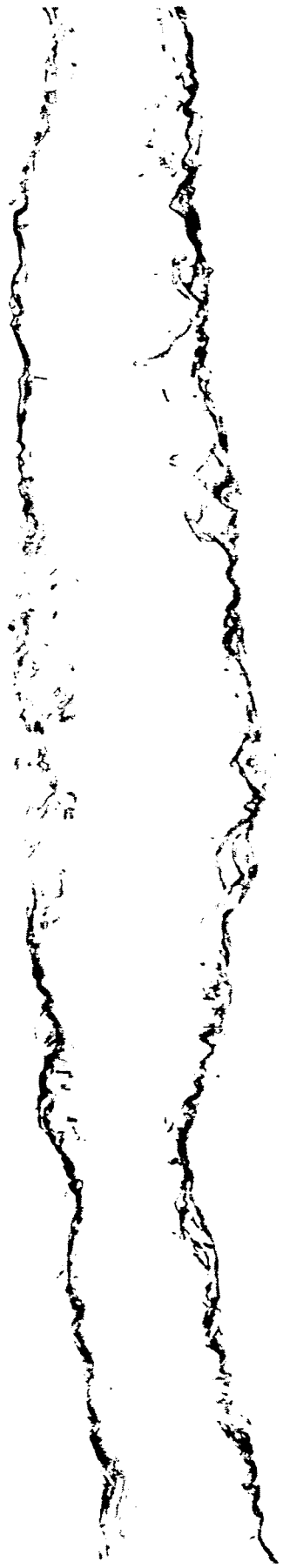
FIG. 6A is a microscopic view of the chemithermomechanical pulp and high bulk additive paper towel.

FIG. 6A is a 50× light microscopy cross-sectional view of the CTMP/HBA towel. As illustrated in FIG. 6B, each unitary ply comprises layer A including approximately 70% Kraft softwood and approximately 30% Kraft hardwood, as well as a layer of HBA plus CTMP including approximately 57% CTMP and approximately 43% HBA. This two layer sheet is combined with an additional identical two layer sheet to form the towel illustrated in FIG. 6B.

The light microscopy cross-sectional view of the embossed, converted and finished paper towel as illustrated in FIG. 6A, indicates a structure which contains a denser outer layer with a finer pore size and pore size distribution and an inner layer of CTMP/HBA containing a unique fiber bend. This inner layer exhibits a surprisingly anfractuous structure. The extent of the delamination in the CTMP/HBA towel did not occur in the three other paper towels. The blend of CTMP/HBA produces an anfractuous structure which is distinct in water absorbency values and water capacity as compared to the control and the CTMP or HBA paper towels.

Figure 7:
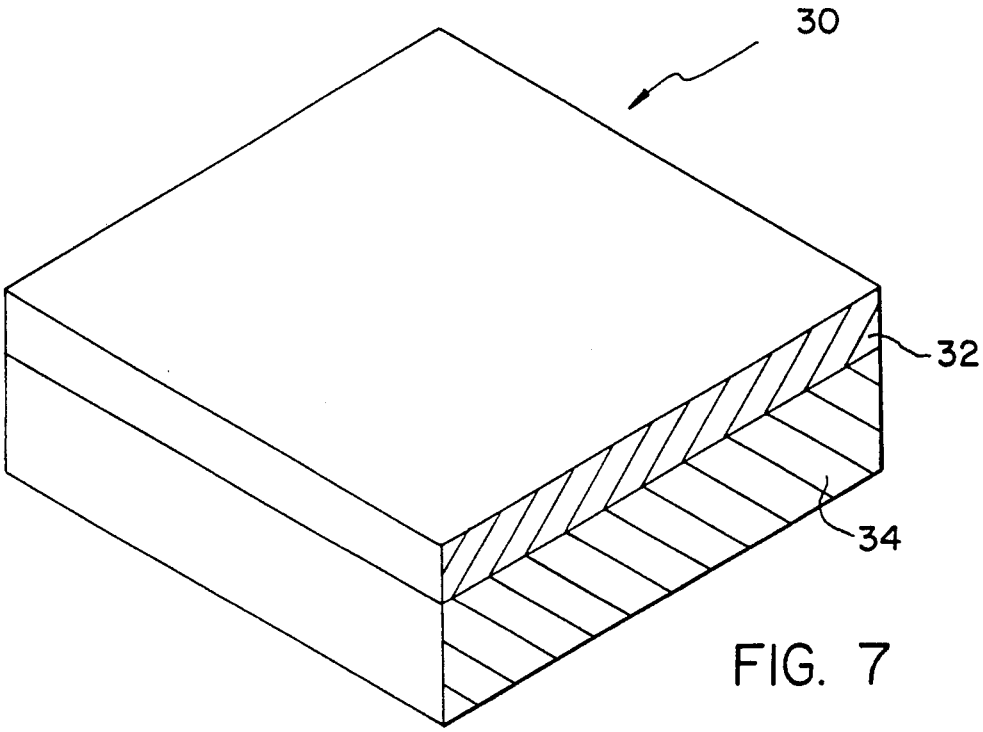
FIG. 7 is a perspective enlarged schematic illustration of the chemi-thermomechanical pulp and high bulk fiber composite stratified structure of the present invention.

FIG. 7 illustrates an enlarged, perspective, schematic view of a portion of the delaminated stratified paper towel 30 according to a first embodiment of the present invention. A first layer 32 is a denser layer with a finer pore size and pore size distribution. A second layer 34 contains a unique fiber blend of approximately 57% CTMP and approximately 43% HBA. The second layer is a delaminated layer for enhancing the rate of absorption and water capacity of said paper towel.

Figure 8:
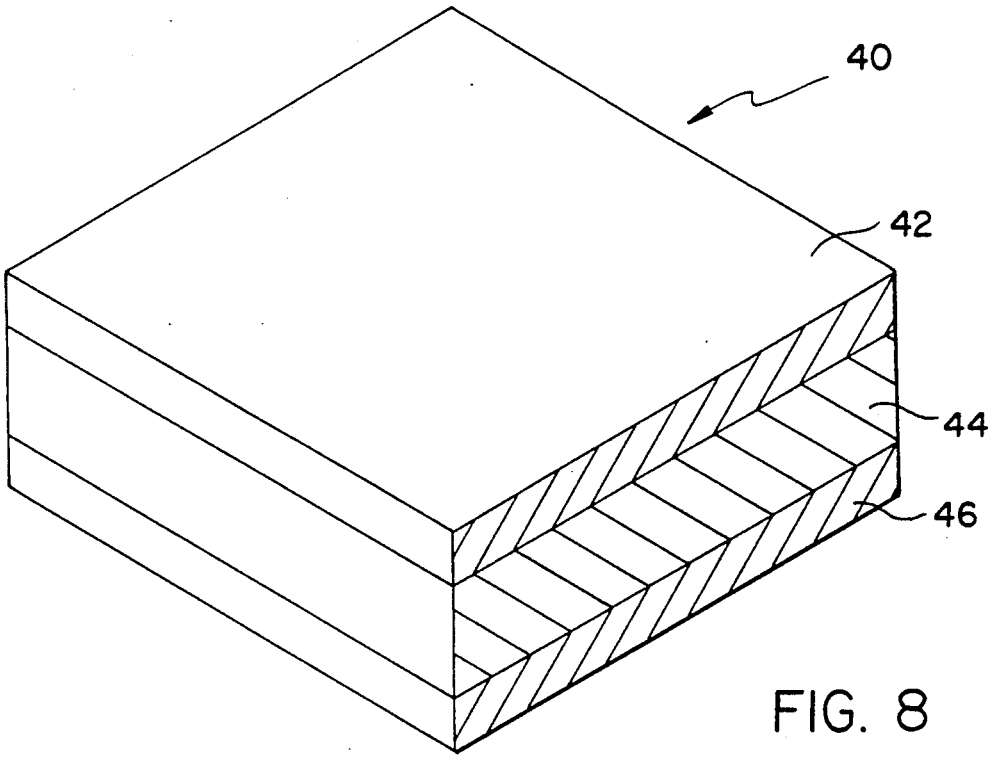
FIG. 8 is a perspective enlarged schematic illustration of the stratified structure of a paper towel according to the present invention which includes three layers.

FIG. 8 illustrates an enlarged, perspective, schematic view of a portion of the delaminated stratified paper towel 40 according to a second embodiment of the present invention. A first layer 42 is a denser layer with a finer pore size and pore size distribution. A second layer 44 contains a unique blend of approximately 57% CTMP and approximately 43% HBA. A third layer 46 is a denser layer with a finer pore size and pore size distribution. The second layer is a delaminated layer for enhancing the rate of absorption and water capacity of said paper towel.

For those applications in which more absorbency is required while strength is less important, towels may be constructed wherein the ratio of the weight of the Kraft layer to the weight of the HBA/CTMP layer is from about 3:2 to about 1:1, the ratios of Kraft to HBA/CTMP from about 3:2 to about 2:1 or higher being preferred for applications where more strength is required.

Figure 9:
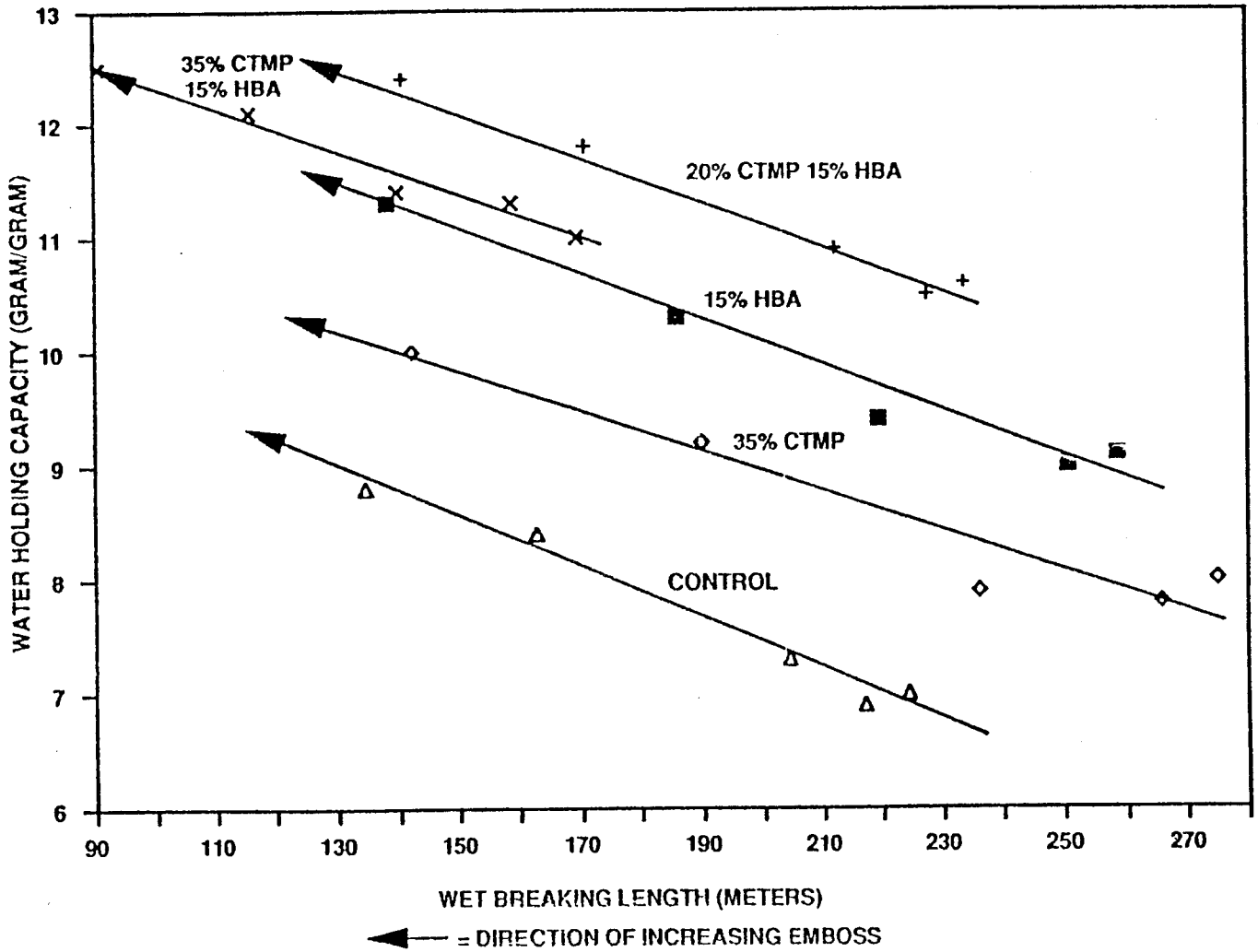
FIG. 9 is a figure analogous to FIG. 2 illustrating data showing water holding capacity for additional paper towel structures.

FIG. 9 illustrates the wet strength of Towel 5 incorporating such a 1:1 blend superimposed on the data of FIG. 2. It can be appreciated that a strength of at least equivalent to a towel described herein as the HBA towel is obtained together with at least equivalent water holding capacity has been obtained. Measurement of the water absorption time of a single ply resulted in a value of 13.8 sec. while the water absorption time of a two-ply towel was about 0.8 sec. both of which times are at least substantially equivalent to those obtained for the HBA towel despite a less expensive pulp has been used. Table 4 summarizes the data for the towels evaluated herein.

The invention being thus described, it will be obvious that the same may be varied in many, ways. Such variations are not to be regarded as a departure from the spirit and scope of the invention, and all such modifications as would be obvious to one skilled in the art are intended to be included within the scope of the following claims.

TABLE 4

| Towel Designation | Composition: Dense Layer | Composition: Absorbent Layer | (thousandths) of an inch (Caliper) | Breaking Length (meters) Dry | Breaking Length (meters) Wet | WHC (gm/gm) | WAT (sec) |
|---|---|---|---|---|---|---|---|
| 1. Control Towel | 45% Pine 20% Gum | 35% Pine | 52.4 | 762 | 199 | 7.0 | 35.6 |
| 2. CTMP Towel | 45% Pine 20% Gum | 35% CTMP | 55.0 | 784 | 237 | 7.1 | 66.5 |
| 3. HBA Towel | 45% Pine 20% Gum | 20% Gum 15% HBA | 59.8 | 749 | 227 | 8.8 | 17.4 |
| 4. CTMP/HBA Towel 1 | 45% Pine 20% Gum | 20% CTMP 15% HBA | 67.6 | 668 | 195 | 9.5 | 11.0 |
| 5. CTMP/HBA Towel 2 | 30% Pine 20% Gum | 35% CTMP 15% HBA | 67.4 | 558 | 186 | 11.0 | 13.8 |

All % as percent of overall furnish.

What is claimed is:

1. A delaminated stratified paper towel comprising:

a first layer of chemical fiber blend; and a second layer of an anfractuous high bulk softwood fiber blend, unitary with said first layer;

said first layer being constructed of a denser chemical softwood and hardwood fiber blend relative to said second layer;

said second layer having approximately 30% to 43% of the anfractuous fiber and approximately 57% to 70% of long mechanical pulp fiber;

wherein said first and second layers enhance a rate of absorption and water capacity as compared to a towel of equal strength not having a layer of anfractuous fiber blend.

2. The delaminated stratified paper towel according to claim 1, wherein said second layer is a fiber blend of the anfractuous fiber and a fiber derived from chemi-thermomechanical pulp.

3. The delaminated stratified paper towel according to claim 2, wherein said anfractuous fiber is a citric acid treated fiber.

4. The delaminated stratified paper towel according to claim 1, wherein the weight of the first layer is approximately 65% of the total weight of the paper towel and the second layer, approximately 35%.

5. The delaminated stratified paper towel according to claim 4, wherein the first layer includes approximately 70% Kraft softwood and approximately 30% Kraft hardwood by weight.

6. The delaminated stratified paper towel according to claim 1, wherein the average water holding capacity of each ply of the paper towel is approximately 9.5 gm/gm.

7. The delaminated stratified paper towel according to claim 6, wherein the average water absorption time of each ply of the finished paper towel is approximately 11 seconds.

8. The delaminated stratified paper towel according to claim 1, wherein two plies of the paper towel are embossed together to an emboss depth of approximately 0.2286 cm, the water holding capacity of the paper towel being approximately 12.4 gm/gm.

9. The delaminated stratified paper towel according to claim 9, wherein the average water absorption time is approximately 0.8 seconds.

10. The delaminated stratified paper towel according to claim 1, and further including a third layer of fiber blend wherein said second layer is disposed between said first and third layers.

11. The delaminated stratified paper towel according to claim 10, wherein the total weight of the first and third layers is approximately 65% of the total weight of the paper towel and the second layer, approximately 35%.

12. The delaminated stratified paper towel according to claim 12, wherein the first and third layers include approximately 70% Kraft softwood and approximately 30% Kraft hardwood by weight.

13. The delaminated stratified paper towel according to claim 11, wherein the anfractuous fiber is a citric acid treated fiber.

14. A method of forming a delaminated stratified web of paper towel material comprising:

supplying a first aqueous furnish of a blend of chemical softwood and hardwood fiber directly to a wire;

supplying a second aqueous furnish of an anfractuous high bulk softwood fiber blend having approximately 30% to 43% of the anfractuous fiber and approximately 57% to 70% of long mechanical pulp fiber onto the first furnish disposed on the wire;

drying the first and second furnishes on a drying means to form a web of paper towel material having a predetermined dryness;

creping the paper towel material off of the drying means; and embossing the paper towel material to a predetermined emboss depth;

wherein the web of paper towel material has an enhanced rate of absorption and water holding capacity as compared to a towel of equal strength not having a layer of bulky anfractuous fiber blend.

15. The method of forming a delaminated stratified web of paper towel material according to claim 14, wherein said second furnish is a fiber blend of the anfractuous fiber and a fiber derived from chemi-thermomechanical pulp.

16. The method of forming a delaminated stratified web of paper towel material according to claim 15, wherein said anfractuous fiber is a citric acid treated fiber.

17. The method of forming a delaminated stratified web of paper towel material according to claim 14, wherein the weight of the layer resulting from the first furnish is approximately 65% of the weight of the paper towel material and the second layer, approximately 35%.

18. The method of forming a delaminated stratified web of paper towel material according to claim 19, wherein the first furnish includes approximately 70% Kraft softwood and approximately 30% Kraft hardwood by weight.

* * * * *